US005158344A

United States Patent [19]

Thurston

[11] Patent Number: 5,158,344

[45] Date of Patent: Oct. 27, 1992

[54] CABINET WITH INTEGRAL PIVOTING TELEVISION SUPPORT

[76] Inventor: Harvey Thurston, 15577 Fernand, Pierrefonds, Quebec, Canada, H9H 1M6

[21] Appl. No.: 468,185

[22] Filed: Jan. 22, 1990

[51] Int. Cl.[5] ..... A47B 81/06

[52] U.S. Cl. ..... 312/7.2; 312/329

[58] Field of Search ..... 312/7.2, 329, 326, 195, 312/270, 202, 197, 201, 20

[56] References Cited

U.S. PATENT DOCUMENTS

| | | | |
|---|---|---|---|
| 1,269,225 | 6/1918 | Sciannamea | 312/197 |
| 1,943,282 | 1/1934 | Bellavia | 312/195 |
| 4,046,437 | 9/1977 | Caron et al. | 312/7.2 |

*Primary Examiner*—Kenneth J. Dorner
*Assistant Examiner*—Gerald A. Anderson

[57] ABSTRACT

A media equipment cabinet with an integral pivoting television console support frame. The support frame comprises a support platform having a pivoting connection to interconnect the platform with the cabinet for pivotal displacement of the support frame on a vertical pivot axis having a pivot connection in a top wall of an opening provided in the cabinet. A wheel support assembly is secured under the support platform for supporting the platform elevated from a flat support surface and facilitating arcuate displacement thereon about the pivot axis so that a television supported on said platform may be angulated outwardly with respect to the cabinet and aligned in a desired direction of viewing of said television console.

11 Claims, 3 Drawing Sheets

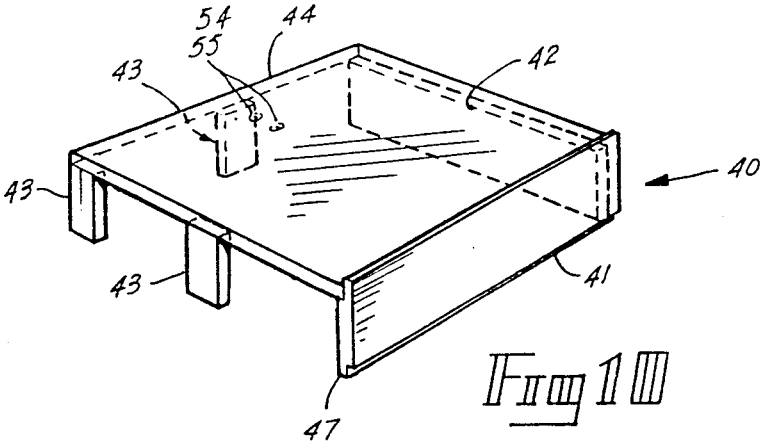
Fig 10
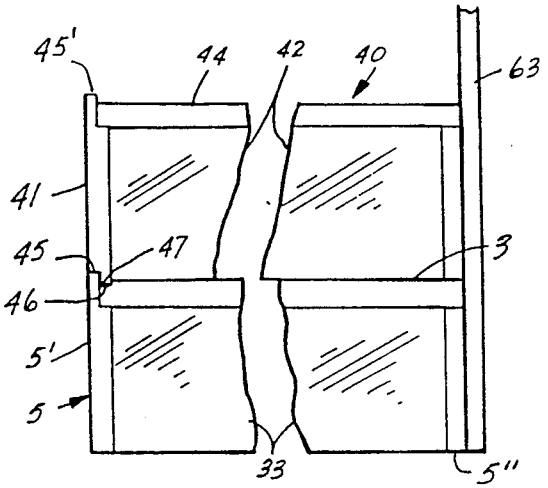
Fig 11
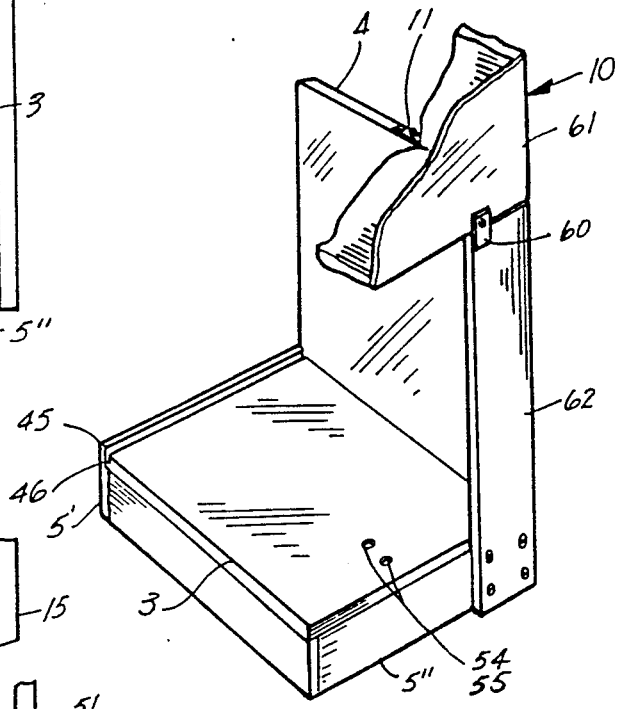
Fig 12
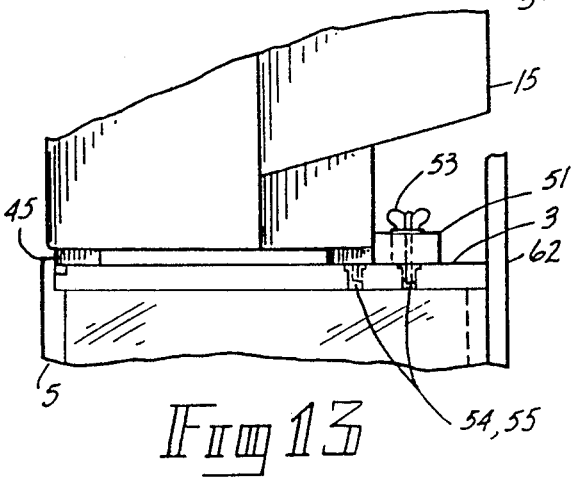
Fig 13
Fig 15
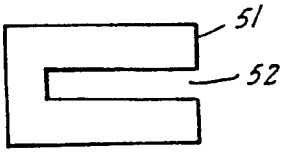

CABINET WITH INTEGRAL PIVOTING TELEVISION SUPPORT

BACKGROUND OF INVENTION (a) Field of the Invention

The present invention relates to a cabinet having an integral pivoting television console support frame and, more particularly, to a media equipment cabinet wherein the support frame is pivotally connected thereto whereby to angulate a television resting thereon outwardly from the cabinet at a desired viewing angle.

(b) Description of Prior Art

Various television support assemblies are known for pivotally connecting a television from a top or bottom support surface. These pivotal connecting assemblies are usually provided by steel mounting brackets secured to a hinge assembly for independently supporting a television about a pivot central to the television. Such support brackets are usually utilized in areas where large viewing audiences gather, such as in pubs, lobbies, etc. It is also known that when viewing television at an angle to the screen, that a certain amount of image distortion occurs and it is therefore preferable to view the television in direct facial alignment therewith. Nowadays, televisions are also equipped with full stereophonic sound systems and the speakers are mounted directly in front of the television console so that in order to benefit from the stereophonic effect of the sound system, one must sit directly in front of the television. If one is viewing the television at an angle, then he is not receiving the full value of the sound or the viewing image. Also, when a television is mounted close to a wall or other accessories, it is often very difficult to have access to the connections at the rear of the television to connect to the power outlet, the television cable and other complementary electronic equipments such as video recorders and channel selectors, particularly if the television is large and heavy. It is therefore necessary to provide a means to render ease of accessability to the back of a television console and to permit angulation of the television to a desired position with the possibility of effortlessly returning the television to a storage position.

SUMMARY OF INVENTION

It is a feature of the present invention to provide a cabinet which has an integral pivoting television console support frame, which provides many of the desired advantages mentioned hereinabove, which is easy to use and which is economical. Another feature of the present invention is to provide a cabinet for media equipment and wherein there is provided an integral pivoting television console support frame to permit a television console to be angulated at desired viewing positions, when necessary, and restored to its storage position aligned within the cabinet.

Another feature of the present invention is to provide a cabinet for media equipment and incorporating therewith an integral pivoting television console support frame to provide ease of access to the back of a television console supported on the support frame.

Another feature of the present invention is to provide a cabinet, as above described, and wherein the console support frame may be provided with an auxiliary support frame to accommodate television consoles of different sizes.

According to the above features, from a broad aspect, the present invention provides a cabinet having an integral pivoting television console support frame. The support frame is comprised of a support platform. A pivoting connection interconnects the support platform with the cabinet for pivotal displacement of the support frame on a vertical pivot axis having a pivot connection in a top wall of an opening provided in the cabinet. A wheel support assembly is secured under the support platform for supporting the platform elevated from a flat support surface and facilitating arcuate displacement thereon so that a television console supported on the platform may be angulated outwardly with respect to the cabinet and aligned in a desired direction of viewing of the television console.

BRIEF DESCRIPTION OF DRAWINGS

A preferred embodiment of the present invention will now be described with reference to the accompanying drawings in which:

FIG. 10 is a perspective view showing the construction of the auxiliary platform;

FIG. 11 is a section view showing the location of the auxiliary platform on the support platform;

FIG. 12 is a fragmented perspective view illustrating the construction of the support platform and the stop member;

FIG. 13 is a fragmented side view illustrating how a television console is clamped on the support surface of the support platform;

FIG. 15 is a plan view of the retention block.

DESCRIPTION OF PREFERRED EMBODIMENTS

Figure 1:
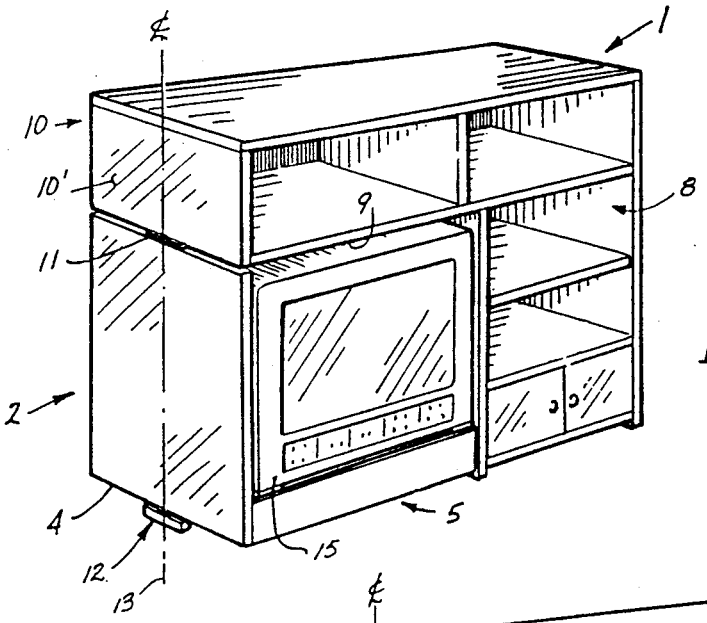
FIG. 1 is a perspective view of a media equipment cabinet incorporating the television console support frame of the present invention, and as seen with the television console in a storage position.
Figure 2:
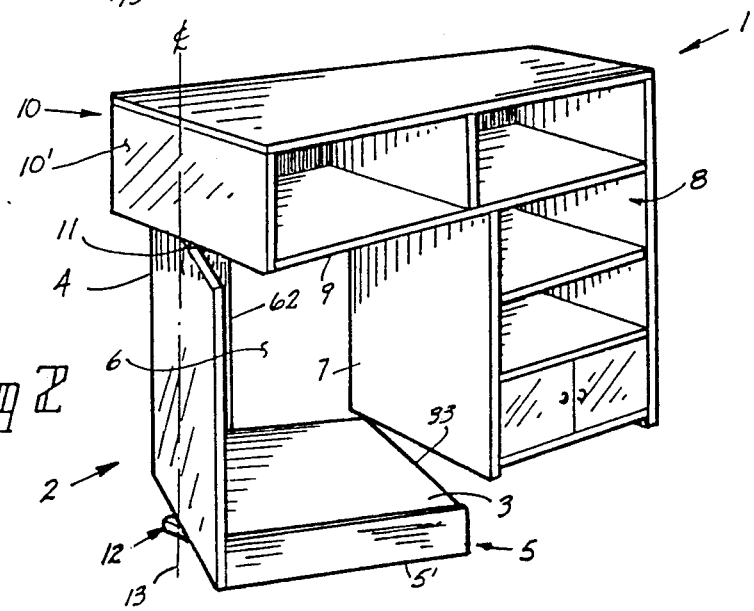
FIG. 2 is a perspective view similar to FIG. 1 but showing the television console support frame angulated outwards to a desired television viewing angle.
Figure 3:
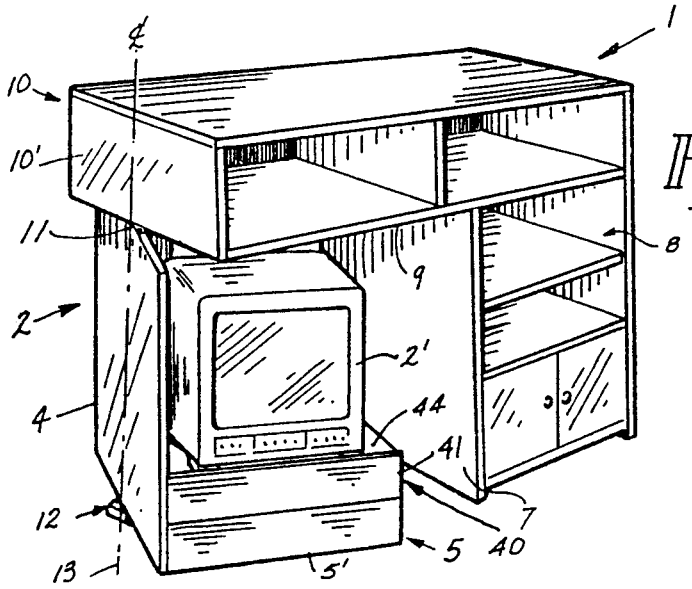
FIG. 3 is the same view as FIG. 2 but with a television console shown supported on an auxiliary platform associated with the support frame.

Referring now to the drawings, and more particularly to FIGS. 1 to 3, there is shown generally at 1, the media equipment cabinet of the present invention. The cabinet 1 is provided with an integral pivoting television console support frame 2 which comprises a support platform 5 having a flat top support surface 3. The support platform 5 is disposed within a side opening 6 defined between a side wall 7 of a shelf unit 8 and a top wall 9 of a projecting wing portion 10 of the cabinet.

Such cabinet is usually constructed for placement against a rear wall of a room and to the right side of a television viewing area in a room.

As can be seen, an outer vertical side wall 4 is secured to the support platform 5 and extends flush with an outer side wall 10' of the projection wing 10. An upper pivot assembly 11 and lower pivoting assembly 12 as shown in FIG. 4, together with the wheel arrangements of FIGS. 4 and 5 provide for the support platform to be displaced about a vertical pivot axis 13 which extends centrally through the side wall 4.

Referring now additionally to FIGS. 4 to 9, it can be seen that the support platform 5 is provided with a wheel support assembly in a bottom wall 14 thereof so that the support platform is supported elevated from a flat support surface, usually the floor of a room or any other support surface on which the cabinet may be mounted, whereby to facilitate the arcuate displacement thereof so that the television console 15 supported on the platform may be angulated outwardly of the cabinet to a desired viewing position, as shown in FIG. 3.

Figure 7:
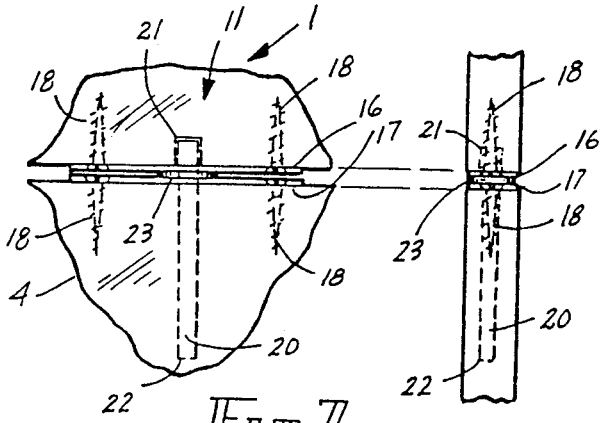
FIG. 7 is is a fragmented side and end elevation view illustrating the construction of the pivoting connection in the top edge of the side wall.
Figure 8:
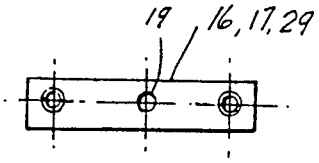
FIG. 8 is a plan view of a pivot bearing plate.

As shown in FIGS. 7 and 8, the upper pivot assembly 11 is comprised of two pivot bearing plates 16 and 17 secured respectively in a top edge 4' of the outer vertical side wall 4 and the bottom outer edge 6' of the outer side wall 6 of the projecting wing 10 and secured thereto by fasteners 18. The bearing plates are provided with a central pivot pin locating hole 19 and a pivot pin 20 extends therethrough and into locating holes 21 and 22 formed respectively in the top edge of the side walls 4 and 6. A bearing washer 23 is interposed between the plates to provide a low friction coupling therebetween.

Figure 4:
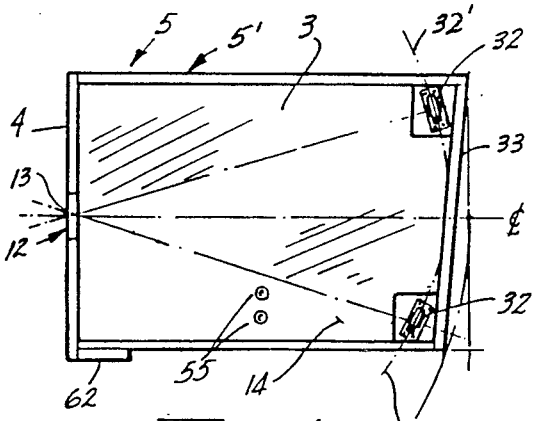
FIG. 4 is a bottom view of the support frame showing one embodiment of the pivoting connection.
Figure 5:
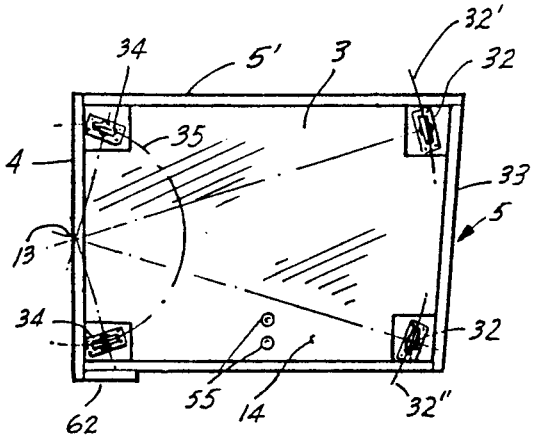
FIG. 5 is a view similar to FIG. 4 but showing another embodiment of the pivoting connection.
Figure 6:
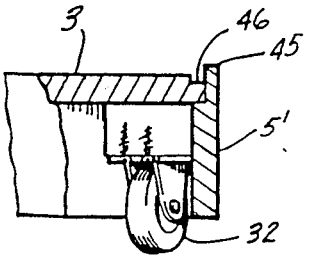
FIG. 6 is a fragmented side view illustrating the corner construction and support wheel associated with the support platform.
Figure 9:
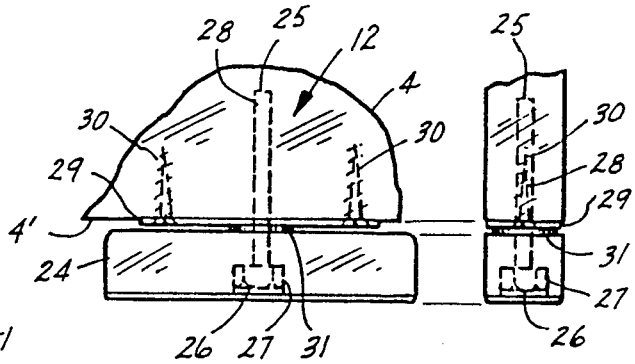
FIG. 9 is a side and end elevation view of the lower pivot assembly.

The lower pivot assembly 12 is secured adjacent a lower edge of the platform and in the embodiment as shown in FIGS. 4 and 9, it consists of a fixed pivot shoe 24 disposed in axial alignment with the vertical pivot axis 13. As herein shown, the lower pivot assembly 12 is constituted by the fixed support shoe 24 having a pivot pin 25 with a head 26 located in a countersunk hole 27 and projecting vertically in alignment with the pivot axis 13 for tight fit within a hole 28 formed in the lower edge 4' of the side wall 4. A further bearing plate 29 having a pivot pin locating hole 19 therein is secured within the bottom edge by screw fasteners 30. A washer 31 is also interposed between the plate and the pivot shoe and disposed about the pivot pin 25. Accordingly, with this embodiment, the support platform 3 is pivoted between two axially aligned pivot pins 20 and 25. A pair of outer support casters 32 (FIG. 4) are secured within respective opposed corners on mounting blocks disposed in the inner side edge of the platform and have their wheel turning or bearing axis disposed in alignment with their arc 32' and 32" formed about the pivot axis 13. Because of the angulated side edge 33, these arcs are different from one another. The angulated inner side edge 33 permits the platform to be closely spaced to the inner side wall 7 of the shelf unit 8 and provides for a clearance with the side wall when the support frame is pivoted outwardly. Of course, the top support surface 3 could be fully rectangular and spaced from the side wall 7.

As shown in FIG. 5, a second pair of casters 34 are secured spaced apart under the platform and adjacent the vertical pivot axis 13. The bearing axis of these casters are also fixed for alignment with the inner arc of rotation 35.

Referring now to FIGS. 10 and 11, it can be seen that an auxiliary rectangular platform 40 may be provided for retention on the flat top support surface 3 of the platform 5. This auxiliary platform 40 is formed with a flat rectangular top wall 44 and front and side walls 41 and 42 respectively. Support blocks 43 are secured in the other side edges of the top wall. The support platform 5, as shown in FIG. 11, is provided with a projecting edge 45 and a rear recess 46 whereby to receive the downwardly projecting flange 47 of the auxiliary platform formed in the lower edge thereof. Accordingly, the auxiliary platform 40 is immovably positioned over the lower support platform 5 so that the front walls 41 and 5' align with one another and are maintained in this aligned position. This auxiliary platform 40 is provided for supporting television consoles, such as the console 2' as shown in FIG. 3 which is of smaller size than the console 15 as shown in FIG. 1. The projecting edge 45' of the auxiliary platform 40 also serves to arrest a television console positioned thereon, as shown in FIG. 13.

Figure 14:
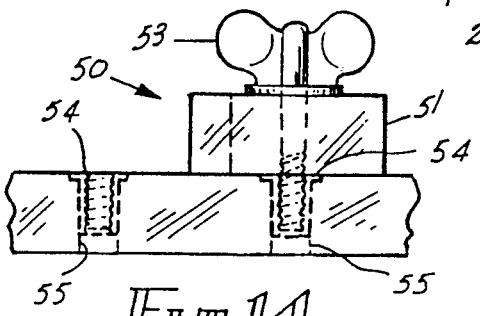
FIG. 14 is a fragmented side view showing the construction of the adjustable retention block.

As shown in FIGS. 13 to 15, the platform is further provided with an adjustable retention means 50 in a rear portion of the horizontal support surface 3 for clampingly securing the television console 15 on the support surface 3 between the front flange edge 45 and the retention means 50. As herein shown, the retention means is constituted by a retention block 51 formed as a U-shaped block with a channel 52 extending therein. A wing fastening screw 53 extends into the slot and into a threaded insert 54 retained in a selected one of a plurality of aligned holes 55 extending in a rear portion of the support surface 3 and in transverse alignment with the front wall 5' of the support platform. Accordingly, the retention block may be located at convenient positions for abutment against the base of a television console, irrespective of the size of the television. Although only two adjustment holes 55 are shown in FIG. 12, a plurality of these may extend along a rear portion of the transverse axis of the platform.

As shown in FIG. 12, there is further provided a stop means in the form of a stop lug 60 which is secured to the rear wall 61 of the projecting wing 10 and projects below the wall 9 of the wing whereby to abut against a projecting member, herein a corner wall portion 62 secured to the outer vertical side wall rear edge and the corner portion of the back wall 5" of the support platform 5. Accordingly, when the support platform is pushed inwardly of the cabinet, it is arrested at a storage position which is flush with the cabinet as shown in FIG. 1. The corner wall portion 62 acts as a brace between the side wall 4 and the platform 5.

An advantage of the support frame of the present invention is that a television console rested thereon can be aligned at a desired viewing angle and can be displaced within an arc of 90° from within the cabinet. As herein shown, the cabinet has a left side opening but cabinets with right side openings are also provided for mounting on an opposed viewing side. After the user has finished viewing a television program, he can then restore the television back into the wall unit by simply pushing on the television, which is braced by the adjustable fastening means, back into the wall unit. Alternatively, the support platform could be displaced by applying pressure against the side wall 4 or else the front panel 5' of the base. The fact that the television console can be hinged out also provides access to the connections at the back of the television and also provides ease of access for servicing the television, when required.

It is within the ambit of the present invention to cover any obvious modifications of the preferred embodiment described herein, provided such modifications fall within the scope of the appended claims.

I claim:

1. A cabinet with an integral pivoting television console support frame, said support frame comprising a support platform, a pivoting connection interconnecting said support platform with said cabinet for pivotal displacement of said support frame on a vertical pivot axis having a pivot point in a top wall of an opening provided in said cabinet, a wheel support assembly secured under said support platform for supporting said platform elevated from a flat support surface on which said cabinet is supported and permitting arcuate displacement thereon so that a television console supported on said platform may be angulated outwards with respect to said cabinet and aligned in a desired direction of viewing of said television console, said support platform being pivotally retained in a bottom portion of said opening provided in said cabinet, said opening having a single closed side wall and an opposed side opening, said platform having an outer vertical side wall extending across an outside end edge of said support platform and closing said side opening, said platform having a flat rectangular horizontal support surface, said pivoting connecting having a pivot pin assembly in a top edge of said outer vertical side wall at said pivot point and pivotally connected to a top member of said opening, and a lower fixed pivot assembly secured in a lower edge of said platform in axial alignment with said vertical pivot axis, said lower fixed pivot assembly having a support shoe which rests on said flat support surface and a pivot pin extending vertically on said pivot axis and extending into a pivot hole in said lower edge of said platform, and a low friction bearing about said pivot pin between said support shoe and said lower edge of said platform.

2. A cabinet as claimed in claim 1 wherein said wheel support assembly is comprised of a first pair of casters secured spaced apart under said platform and adjacent an outer side edge of said platform through which said vertical pivot axis is disposed, and a second pair of casters secured spaced apart under said platform adjacent an opposed inner side edge of said platform.

3. A cabinet as claimed in claim 2 wherein said pairs of casters are fixed casters having their wheel turning axis aligned along a respective one of two arcs of displacement formed from said vertical pivot axis, said platform having a rectangular base with said casters secured in a respective corner of said rectangular base.

4. A cabinet as claimed in claim 1 wherein said vertical pivot axis is located centrally of said outer vertical side wall, said pivot pin assembly being secured in a top flat edge of said outer vertical side wall.

5. A cabinet as claimed in claim 4 wherein there is further provided an adjustable retention means secured in a rear portion of said horizontal support surface for clampingly securing a television console on said support surface between a front flange edge of said support platform and said retention means.

6. A cabinet as claimed in claim 4 wherein said support platform is provided with auxiliary platform retention means for securing and aligning an auxiliary support platform over said horizontal support surface.

7. A cabinet as claimed in claim 4 wherein said cabinet is a media equipment cabinet provided with shelf units and having an elevated horizontal projecting wing, said wing defining said top wall of said opening, said flat horizontal support surface having an angulated inner side edge to permit arcuate displacement thereof on said pivot axis against said single closed side wall.

8. A cabinet as claimed in claim 7 wherein there is further provided rear abutment means to locate said support platform flush within said cabinet.

9. A cabinet as claimed in claim 8 wherein said rear abutment means is constituted by a stop lug secured to said cabinet and projecting from under said top wall and aligned with a rear projecting member secured to said outer vertical side wall.

10. A cabinet as claimed in claim 1 wherein said platform has an angulated inner side edge adjacent said closed side wall for clearance therewith when said platform is angulated outwards.

11. A cabinet with an integral pivoting television console support frame, said support frame comprising a support platform, a pivoting connection interconnecting said support platform with said cabinet for pivotal displacement of said support frame on a vertical pivot axis having a pivot point in a top wall of an opening provided in said cabinet, a wheel support assembly secured under said support platform for supporting said platform elevated from a flat support surface on which said cabinet is supported and permitting arcuate displacement thereon so that a television console supported on said platform may be angulated outwards with respect to said cabinet and aligned in a desired direction of viewing of said television console, said support platform being pivotally retained in a bottom portion of said opening provided in said cabinet, said opening having a single closed side wall and an opposed side opening, said platform having an outer vertical side wall extending across an outside end edge of said support platform and closing said side opening, said platform having a flat rectangular horizontal support surface, said pivoting connecting having a pivot pin assembly in a top edge of said outer vertical side wall at said pivot point and pivotally connected to a top member of said opening, and a lower fixed pivot assembly secured in a lower edge of said platform in axial alignment with said vertical pivot axis, said lower fixed pivot assembly being comprised of a first pair of casters secured spaced apart under said platform and adjacent an outer side edge of said platform through which said vertical pivot axis is disposed, and a second pair of casters secured spaced apart under said platform adjacent an opposed inner side edge of said platform.

* * * * *